US006767281B2

(12) United States Patent
McKee

(10) Patent No.: US 6,767,281 B2
(45) Date of Patent: Jul. 27, 2004

(54) PASSIVE VENTING DEVICE

(75) Inventor: James H. A. McKee, Barrie (CA)

(73) Assignee: Canplas Industries Ltd. (CA)

( * ) Notice: Subject to any disclaimer, the term of this patent is extended or adjusted under 35 U.S.C. 154(b) by 0 days.

(21) Appl. No.: 10/246,979

(22) Filed: Sep. 19, 2002

(65) Prior Publication Data

US 2003/0054754 A1 Mar. 20, 2003

(30) Foreign Application Priority Data

Jan. 25, 2002 (CA) ..... 2364672

(51) Int. Cl.[7] ..... F24F 7/04
(52) U.S. Cl. ..... 454/367; 454/366
(58) Field of Search ..... 454/366, 367; 52/198, 199, 200

(56) References Cited

U.S. PATENT DOCUMENTS

| | | | | | |
|---|---|---|---|---|---|
| 1,547,916 | A | | 7/1925 | Hoffman | |
| 2,628,551 | A | * | 2/1953 | Leigh | 454/366 |
| 3,085,490 | A | | 4/1963 | Field | |
| 3,934,383 | A | | 1/1976 | Perry et al. | |
| 4,196,657 | A | | 4/1980 | Crongeyer et al. | |
| 4,307,549 | A | | 12/1981 | Clanton | |
| 4,357,381 | A | | 11/1982 | Wilson | |
| 4,468,899 | A | | 9/1984 | Miller | |
| 4,621,569 | A | | 11/1986 | Fioratti | |
| 4,683,687 | A | | 8/1987 | Crider | |
| 4,730,552 | A | | 3/1988 | Murray | |
| 5,062,247 | A | | 11/1991 | Dittmer | |
| 5,212,913 | A | | 5/1993 | Whitehead | |
| 5,341,610 | A | | 8/1994 | Moss | |
| 5,402,611 | A | * | 4/1995 | Vagedes | 52/198 |
| 5,435,780 | A | | 7/1995 | Ayles | |
| 5,561,952 | A | | 10/1996 | Damron | |
| D376,007 | S | | 11/1996 | Thomas | |
| 5,591,080 | A | * | 1/1997 | Ward | 454/359 |
| 5,675,940 | A | | 10/1997 | Behar et al. | |
| 6,155,008 | A | | 12/2000 | McKee | |
| 6,293,862 | B1 | * | 9/2001 | Jafine et al. | 454/359 |
| 6,302,787 | B1 | * | 10/2001 | Graft, Jr. | 454/366 |

* cited by examiner

*Primary Examiner*—Gregory Wilson
(74) *Attorney, Agent, or Firm*—Hoffmann & Baron, LLP

(57) ABSTRACT

A passive venting device for venting enclosures comprising a base member, including an attachment portion and a vent structure for permitting gas and vapour to pass through the device; a cover member mounted to the base member so as to permit the flow of gas and vapour to the outside; and a precipitation baffle which is sized, shaped and positioned to interfere with the entry of precipitation from the outside. The device also has a ventilation pathway spaced from the roof so as to permit thick shakes or tiles to be installed right up to the device without interfering with ventilation.

31 Claims, 11 Drawing Sheets

PASSIVE VENTING DEVICE

FIELD OF THE INVENTION

This invention relates generally to the field of venting devices, and in particular, to passive venting devices.

BACKGROUND OF THE INVENTION

Virtually all buildings and enclosures where human activity takes place require venting of one type or another. The type of venting device employed will depend on the kind of enclosure to be vented. For example, bathrooms containing showers typically have active vents with fans to vent steam to the outdoors. Kitchens, particularly in restaurants and hotels, similarly have powered vents for removing smoke and steam to the outdoors.

Other types of enclosures, such as attics, do not require active venting. However, such enclosures do typically require a passive vent to allow for air flow from the enclosure to the atmosphere. Such venting is required, for example, to prevent a buildup of moisture in the enclosure. Notably, the venting of attic spaces by this method is required by the building codes of many jurisdictions.

Passive vents do not include a mechanism for forcing air out of the enclosure. Rather, they simply include a vent structure in the form of an air conduit which allows air flow. Passive vents are well-known and have been extensively used in the past. Although often formed of metal, good results have been achieved more recently with plastic vents.

House attics and other similar enclosures are sometimes vented simply by one or more passive venting devices on the roof. The passive venting devices are each positioned above a ventilation passage in the roof which permits air to flow from the enclosure to the outside.

In other cases, a more sophisticated venting system is used. Such a system includes intakes for bringing air into the enclosure, operating together with vents permitting air to flow out of the enclosure. Ideally, such a system causes outside air to flow through the enclosure. In this way, gases and vapours in the enclosure, including water vapour, are carried out of the enclosure by the air flow through the vents. Moisture and temperature are thus equalized between the enclosure and the outside.

For example, on sloped roofs, it is common to have intakes installed at the eaves for bringing air into the attic. Vents for venting air out of the attic are installed higher up on the roof, near the peak. Thus, warm moist air within the enclosure rises and flows out through the vents. Air from the outside is taken into the enclosure through the intakes because of the pressure differential created by the outflow of air through the vents.

Historically, part of the function of a vent has been to allow the flow of air through the passage, without permitting moisture, such as rain or snow, to enter the enclosure through the passage. Thus, prior art vents have included features preventing the same.

For example, U.S. Pat. No. 6,155,008 issued Dec. 5, 2000 to McKee (hereinafter "McKee") discloses a passive venting device for venting a building enclosure. The device includes a base member having a vent structure therein. The vent structure is to be positioned over the ventilation passage which extends through the roof of the enclosure. The device also includes a cap member which is positioned over the vent structure to prevent rain and snow from falling directly into the vent structure and through the passage. The cap member, however, is spaced apart from the base to allow air to flow between the cap and the base and through the vent structure.

It has been found that, despite the presence of a cap over the vent structure in devices such as the McKee device, precipitation, such as snow, can occasionally pass into the enclosure through the vent structure. This is because, with the McKee device, snow accumulates at the base of the device, near the bottom edge of the cap. Experience has shown that wind travelling along the sloped roof will often drive the snow up under the cap and through the vent structure into the attic.

This problem can be exacerbated in cases where the eaves intakes become blocked, are improperly installed, or do not exist. In such cases, the vent can act as an intake vent. For example, where there is no air inflow from the eaves, when air flows out of one vent, it must flow in through another vent. Or, air may flow out through one region of the vent structure of a vent while flowing in through another region the vent structure. In either event, if any air flows into the vent, snow or rain present near the vent can be drawn into the enclosure. Any snow blown toward the vent structure will be more likely to enter if the air flow passes into the vent.

It has also been found that, though devices such as the McKee device are generally effective in blocking the entry of rain into the attic, they can leak during extreme weather conditions such as torrential rain. There are at least two reasons for this. First, torrential rains are often accompanied by high winds, which can drive rain drops into the vent structure in the same way described above with respect to snow. Second, because there is a great deal of rain falling very hard, rain drops can strike the device, bounce up under the cap, and enter the vent structure. As with snow, more rain will enter the attic in cases where the device is acting as a full or partial intake.

Another issue with respect to roof vents is their use in conjunction with roofing materials such as shingles, shakes or tiles. The venting device disclosed in McKee includes a wide nailing flange which is nailed to the roof to permit shingles to be lapped over the flange. Thus, on a sloped shingled roof, shingles are installed on top of the flange on the top end and side ends of the flange. At the bottom, the flange overlaps the shingles. In this manner water is shed off the roof.

To provide an appropriate seal for the roof, shingles are typically lapped over the flange right up to the vent structure in the centre of the device. One reason that this is done is to reduce the probability that water will enter under the sides of the shingles. However, two problems arise with this approach.

First, the vent structure often has an uneven shape, which makes it difficult or inconvenient to install shingles right up against the vent structure. Doing so would require the shingles to be cut in the same uneven or jagged pattern as the vent structure. Thus, there is often space between the vent contours of the structure and the shingles, permitting water to work its way under the shingles from the side.

Second, the shingles are installed on top of the flange, where they can interfere with the air flow of the vent. This is because, in devices such as that disclosed in McKee, air flows through a gap formed between the cap and the flange. On the one hand, the gap is located as low as possible to reduce the likelihood of water getting into the vent structure. On the other hand, a low gap means that the shingles, if placed over the flange and in the gap, will reduce the height of the gap and hence the air flow.

Because shingles, in particular, are relatively thin, this second problem may not be particularly severe when shingles are used. However, other commonly used roofing materials, such as, for example, cedar shakes or clay tiles, are significantly thicker. Thus, shakes and tiles often cannot be used with prior art devices such as McKee, as their thickness interferes with the air flow through the gap and thus into the vent.

SUMMARY OF THE INVENTION

Therefore, what is desired is a passive venting device that is simple and inexpensive to manufacture and install. The device will allow for the efficient passive venting of an enclosure while preferably eliminating or substantially reducing the entry of precipitation into the enclosure through the device. The device will also preferably be usable with a variety of roofing materials, including shakes and tiles, without air flow through the vent being interfered with.

Therefore, according to one aspect of the invention, there is provided a passive venting device for venting a building enclosure to an outside, the device comprising:

a base member, including an attachment portion for securing the base member in fluid communication with a ventilation passage through a surface of the building enclosure, and a vent structure for permitting gas and vapour to pass through the device, the vent structure having a vent opening;

a cover member mounted to the base member, the cover member and the base member being sized, shaped and positioned so as to permit the flow of gas and vapour from the vent opening to the outside;

a precipitation baffle, extending from at least one of the base member and the cover member, the precipitation baffle being sized, shaped and positioned both to interfere with the entry of precipitation from the outside into the enclosure through the vent opening, and to permit gas and vapour to flow to the outside through the vent opening.

According to another aspect of the invention, there is provided a passive venting device for venting a building enclosure to an outside, the device comprising:

a base member, including an attachment portion for securing the base member in fluid communication with a ventilation passage through a surface of the building enclosure, and a vent structure for permitting gas and vapour to pass through the device, the vent structure having a vent opening;

a cover member mounted to the base member, the cover member having a ventilation pathway extending therethrough, the ventilation pathway being sized, shaped and positioned to permit the flow of gas and vapour from the vent opening to the outside along the ventilation pathway;

the cover member being sized, shaped and positioned on the base member such that roofing material may be installed in abutment with the cover member, the ventilation pathway having an exit from the cover member, the exit being spaced from the base member so as to permit the roofing material to be installed abutting the cover member without interference with the exit.

BRIEF DESCRIPTION OF THE DRAWINGS

Reference will now be made, by way of example only, to drawings of the invention, which illustrate the preferred embodiment of the invention, and in which.

DETAILED DESCRIPTION OF THE PREFERRED EMBODIMENTS

Figure 1:
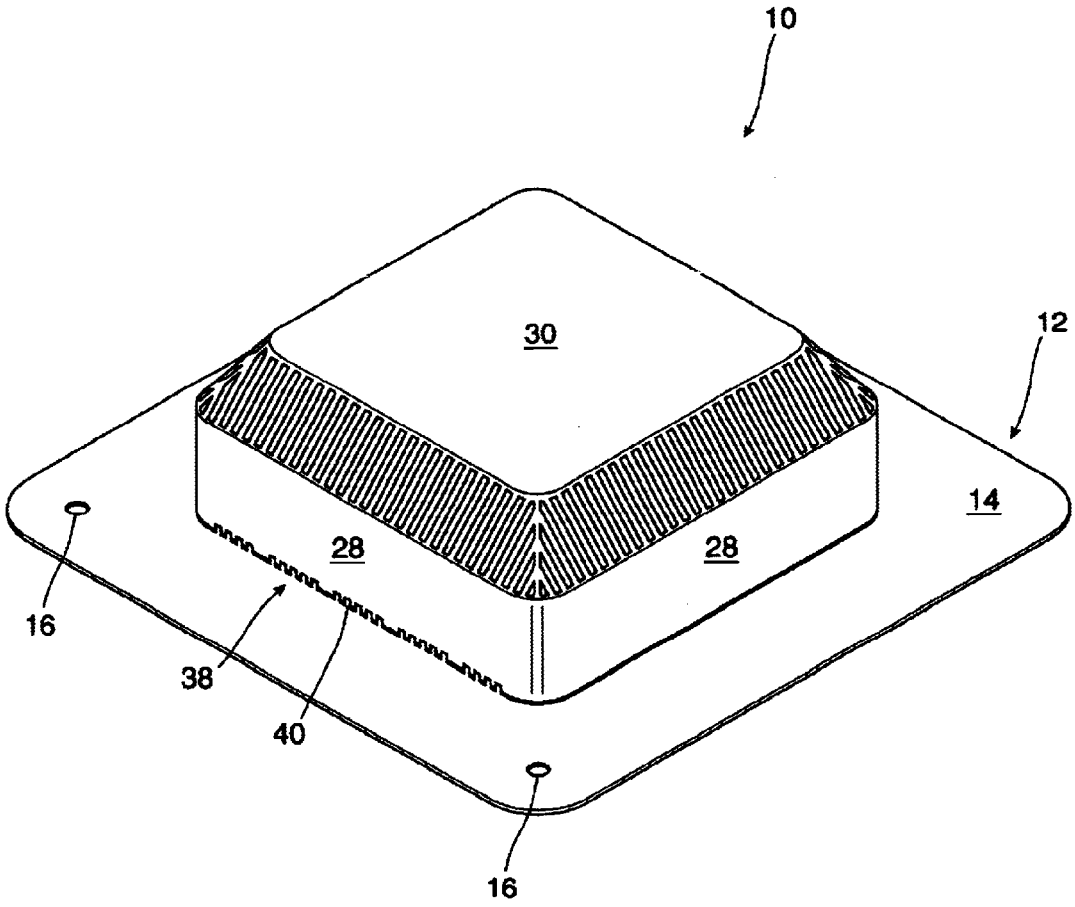
FIG. 1 is a perspective view of the passive venting device according to the present invention.
Figure 2:
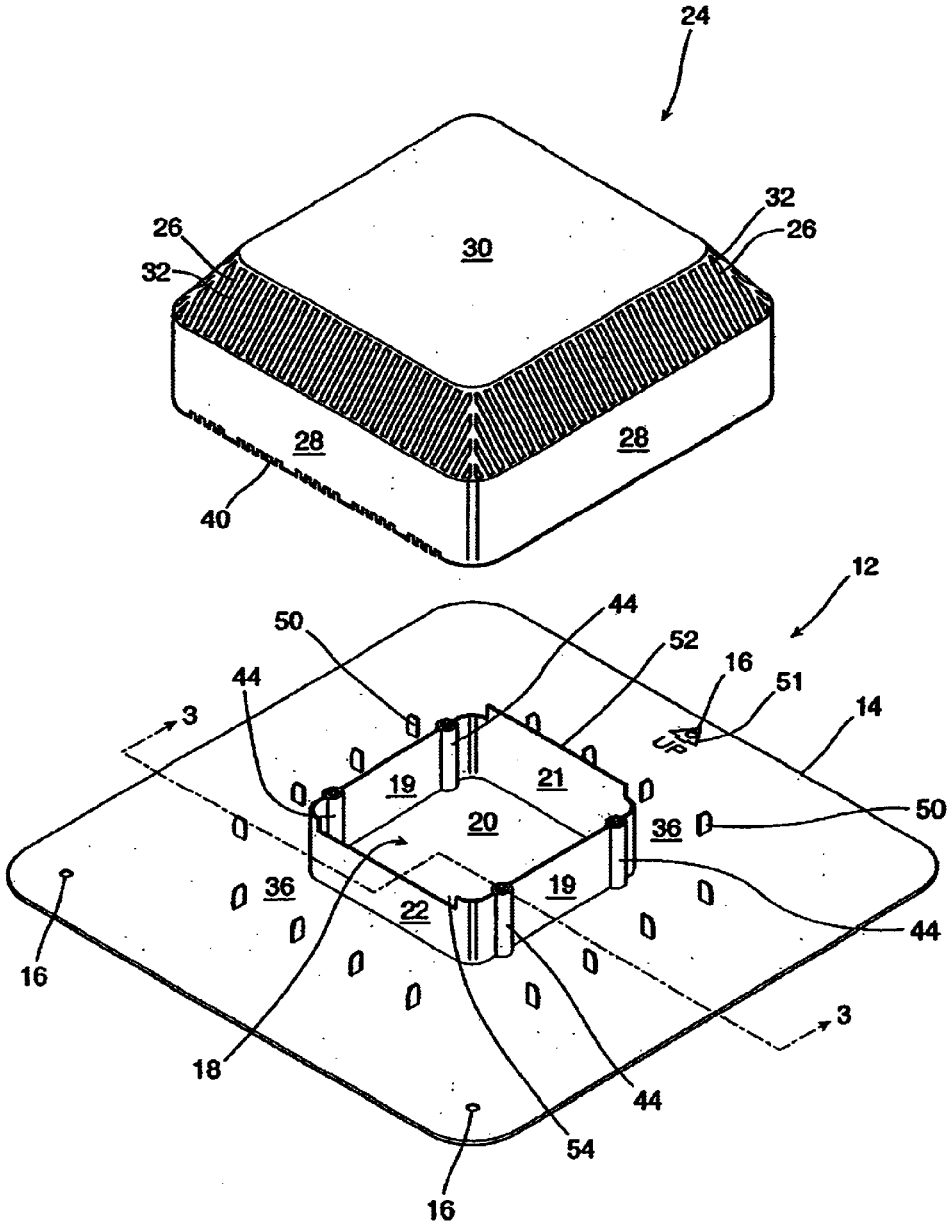
FIG. 2 is a perspective exploded view of the passive venting device according to the present invention.
Figure 3:
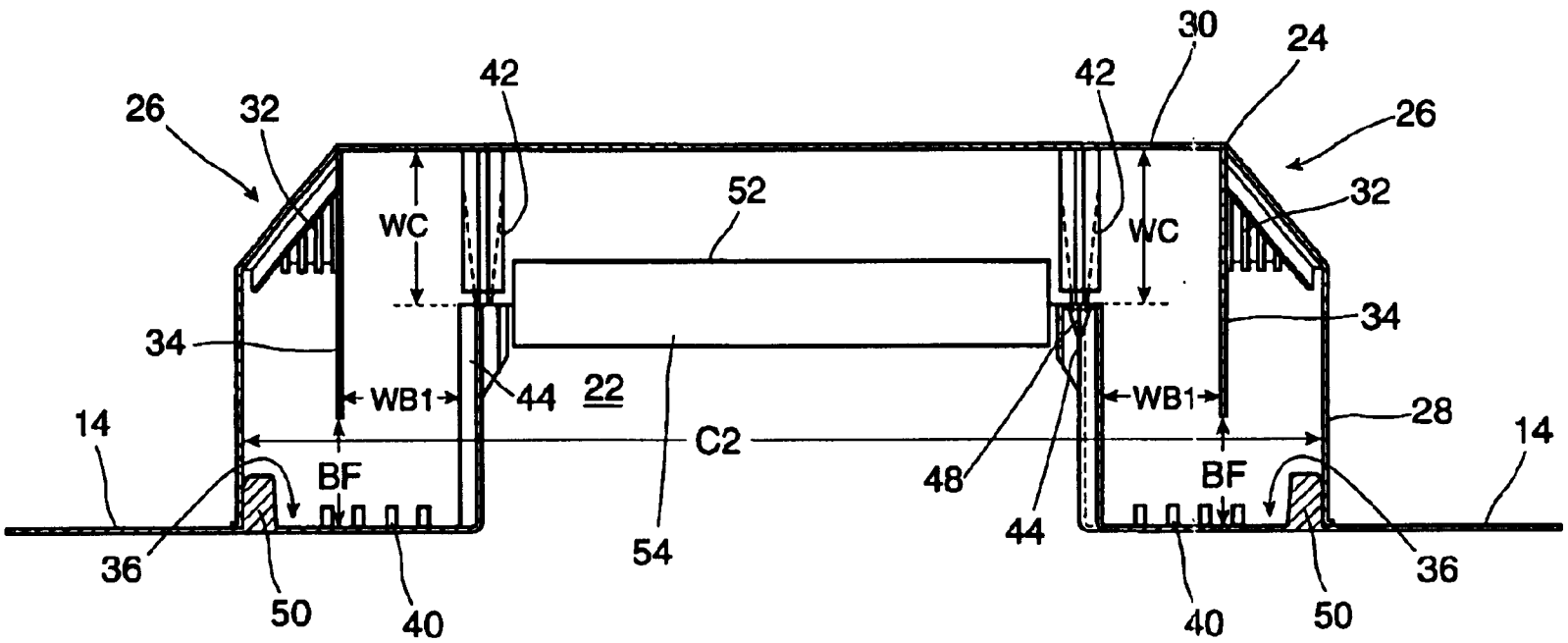
FIG. 3 is a cross-sectional view of the passive venting device taken along line 3—3 of FIG. 2.
Figure 4:
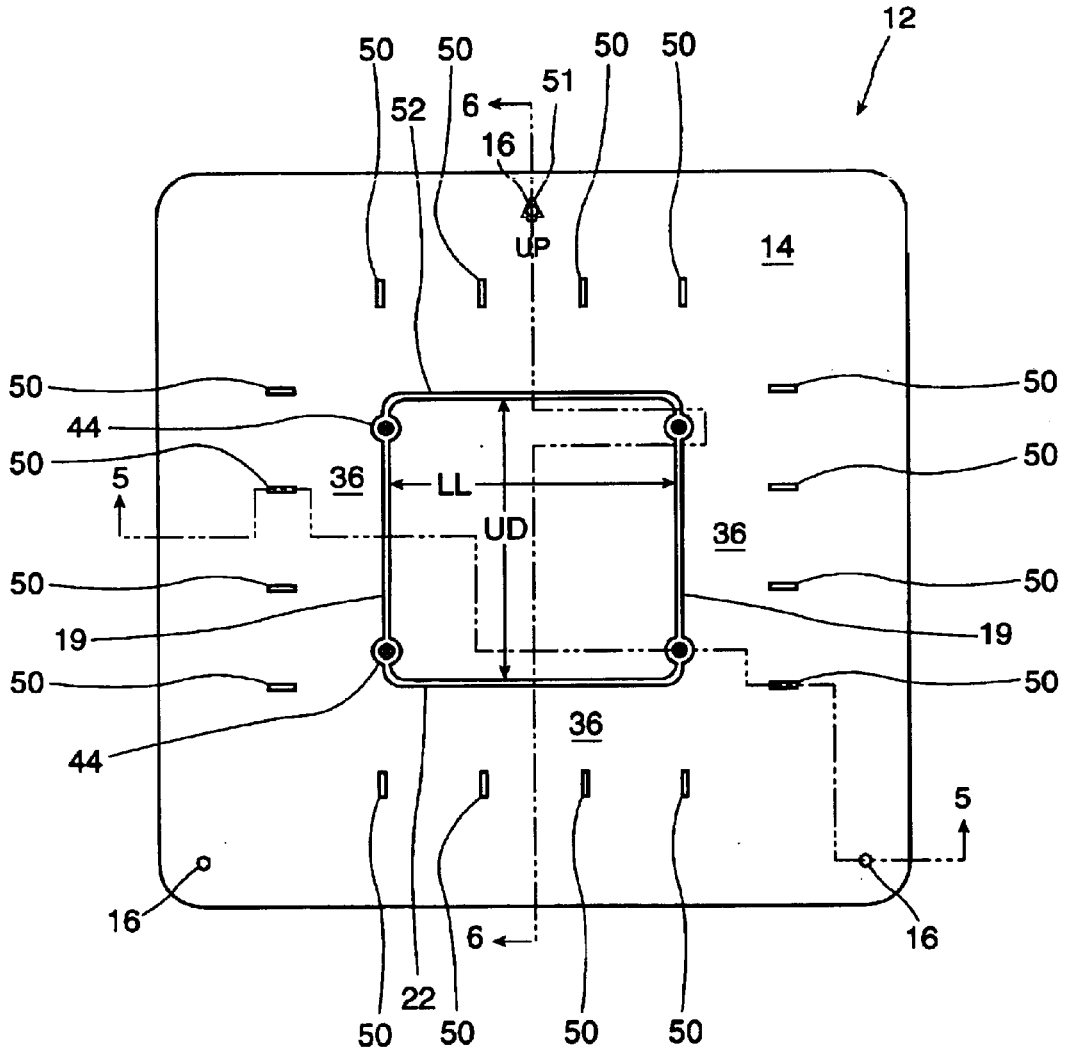
FIG. 4 is a top view of the base member of the passive venting device according to the present invention.
Figure 5:
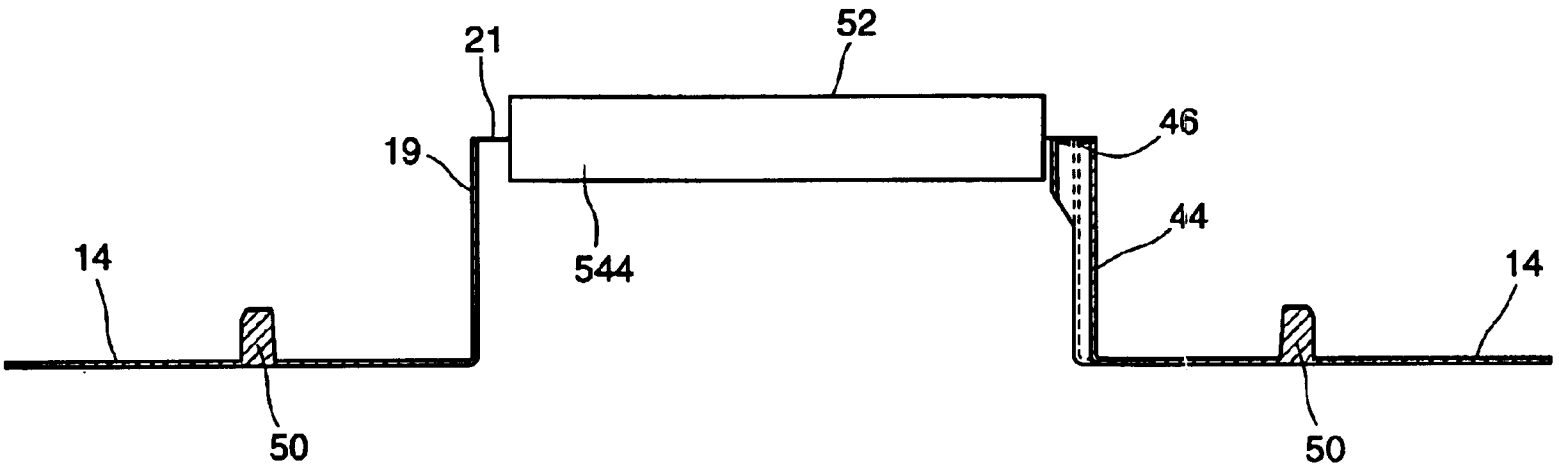
FIG. 5 is a cross-sectional view of the base member taken along line 5—5 of FIG. 4.
Figure 6:
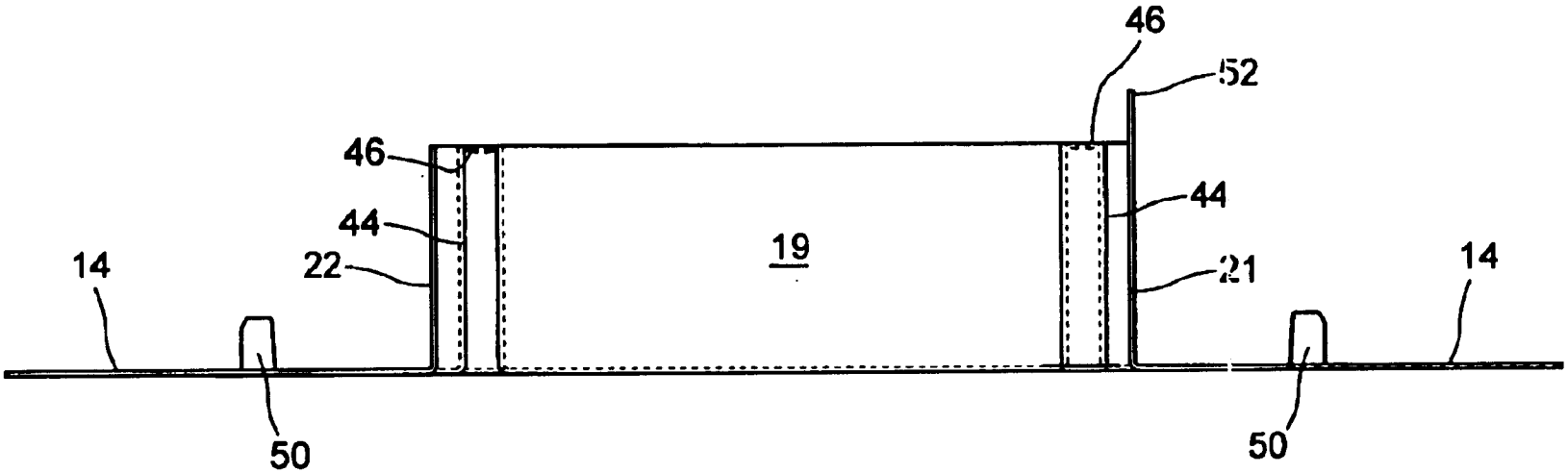
FIG. 6 is a cross-sectional view of the base member taken along line 6—6 of FIG. 4.

The passive venting device, generally designated by the reference numeral 10, is for venting a building enclosure to the outside. Most preferably, the device 10 will be used as a roof vent on a sloped roof, to vent gases and vapours from an attic space to the outside.

Preferably, the device 10 will be manufactured from molded plastic. Moldable plastics are available which provide adequate performance in the range of weather conditions that a typical passive venting device must endure. Furthermore, the use of a plastic molding process allows a high volume of devices to be manufactured at a low per-unit cost. Nevertheless, it will be appreciated that the device 10 need not be composed of molded plastic, but may be composed of any material which allows the device 10 to adequately perform its necessary functions. Thus, for example, the device 10 could be composed of metal.

The device 10 includes a base member 12. The base member 12 includes an attachment portion in the form of a thin, flat, wide outer flange 14 for securing the base member 12 in fluid communication with a ventilation passage through the roof of the building. The flange 14 preferably includes nailing holes 16 for allowing nails to be driven through the holes 16 and into a roof, to secure the base member 12. The wide flange 14 permits shingles to be lapped over the device, so the device is readily integrated into a shingled roof in a waterproof manner.

It will be appreciated that the present invention comprehends various forms of attachment portions other than the flange 14 shown for the preferred embodiment. What is important is that the device 10 have an attachment portion which allows the base member 12 to be secured appropriately in fluid communication with the ventilation passage in order to allow venting to take place. Thus, for example, the attachment portion may be a different shape than the wide, flat, flange 14 of the preferred embodiment. Also, the attachment portion need not necessarily include, for example, the nailing holes 16. Rather, the base member 12 may be attached to the roof by other suitable means, such as screws, glue or any other means that results in the base member being appropriately secured in fluid communication with a ventilation passage through the surface of the building enclosure.

The base member 12 further includes a vent structure 18. The vent structure 18 includes a vent opening 20. The vent structure also includes a vent structure wall comprising two lateral wall sections 19, an upward wall section 21 and a downward wall section 22. The upward wall section 21 is for facing upward on a sloped roof, while the downward wall section 22 is for facing downward on a sloped roof. The lateral wall sections 19 are for facing sideways when the device is installed on a sloped roof.

The vent opening 20 is thus, in the preferred embodiment, formed by the upper edges of the wall sections 19, 21 and 22. The vent opening 20 is preferably generally rectangular in shape in plan view. However, it will be appreciated that this particular preferred structure is not necessary for the invention. What is important is that the vent structure include a vent opening 20 through which air can flow from inside the building enclosure, through the ventilation passage, and out through the vent opening 20.

Thus, the vent opening 20 (i.e., the opening of the vent structure which is closest to the "outside") is spaced upward from the flange 14. On a sloped roof, during periods of rain or when snow is melting, water will flow down the roof and onto the flange 14. Because the vent opening 20 is spaced apart from the flange 14 by the wall sections 19, 21 and 22, this water does not flow into the building enclosure through the vent opening 20. Rather, the water will typically strike the upward wall section 21, flow around the vent structure 18, and then continue down the sloped roof.

The device 10 further comprises a cover member 24 mounted to the base member 12. The purpose of the cover member 24 is to span across the vent opening 20, and prevent precipitation from falling directly through the vent opening 20 into the building enclosure.

The cover member 24 and base member 12 are sized, shaped and positioned so as to permit the flow of gas and vapour from the vent opening 20 to the outside. Thus, preferably, the cover member 24 will have a ventilation pathway 26 extending therethrough, the ventilation pathway 26 being sized, shaped and positioned to permit the flow of gas and vapour from the vent opening 20 to the outside along the ventilation pathway 26.

Figure 7:
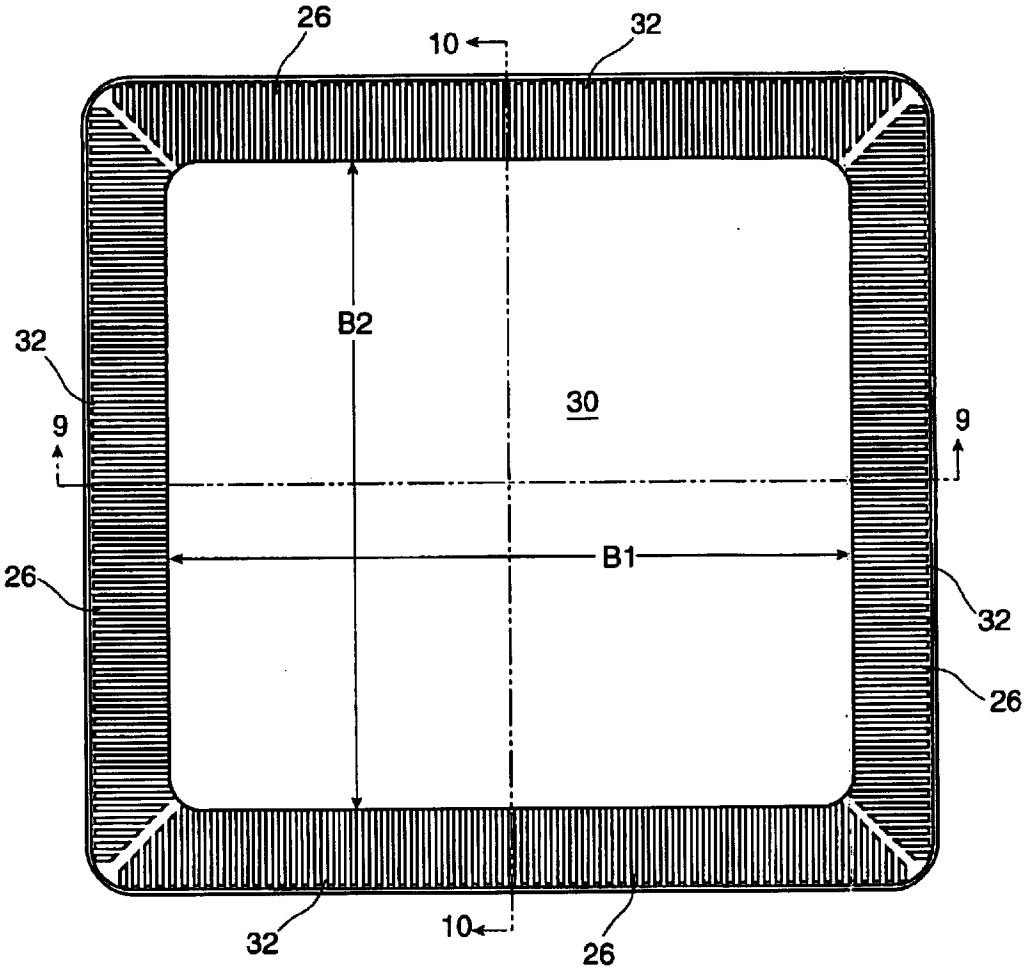
FIG. 7 is a plan (top) view of the cover member of the passive venting device according to the present invention.
Figure 8:
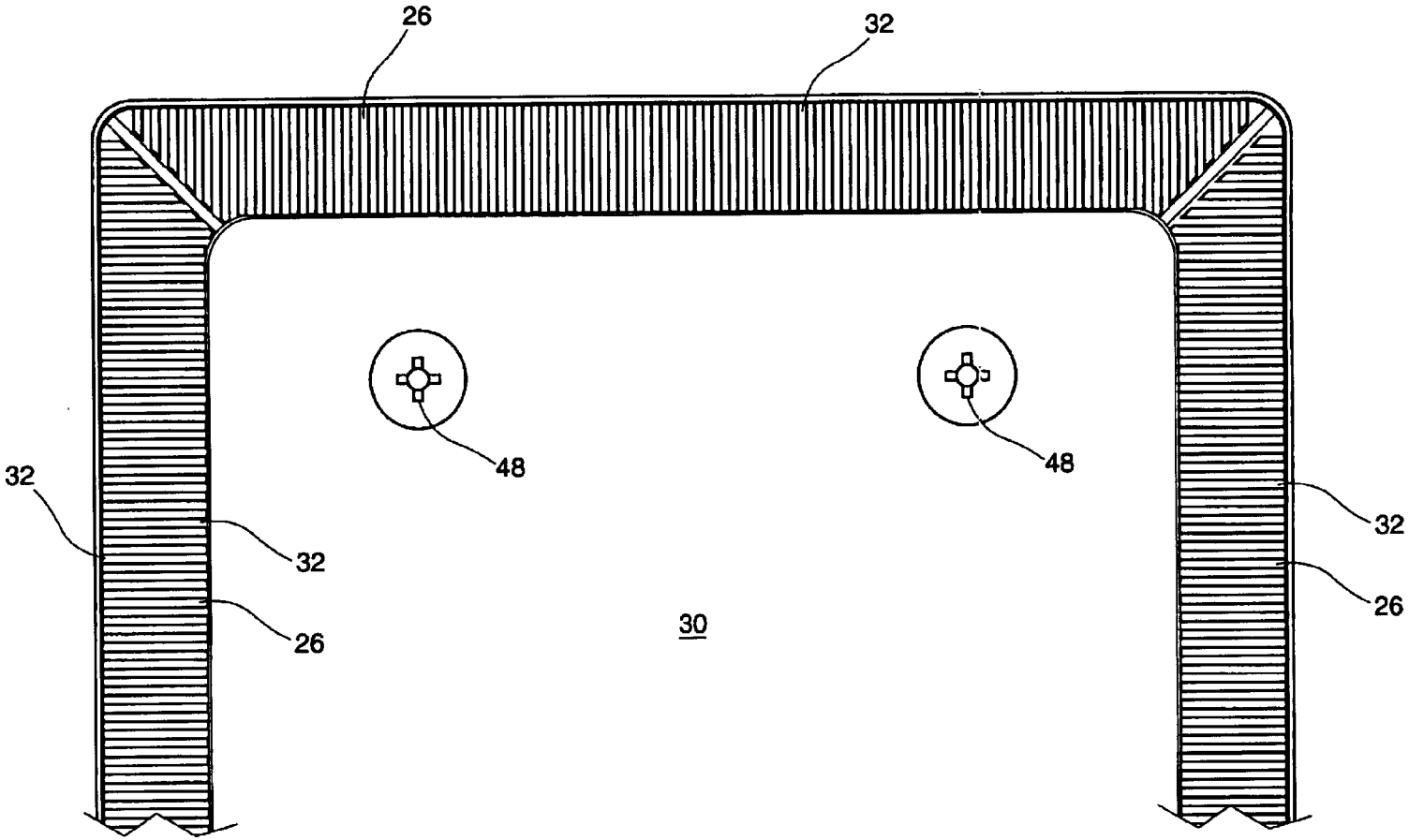
FIG. 8 is a partial bottom view of the cover member of the passive venting device according to the present invention.
Figure 9:
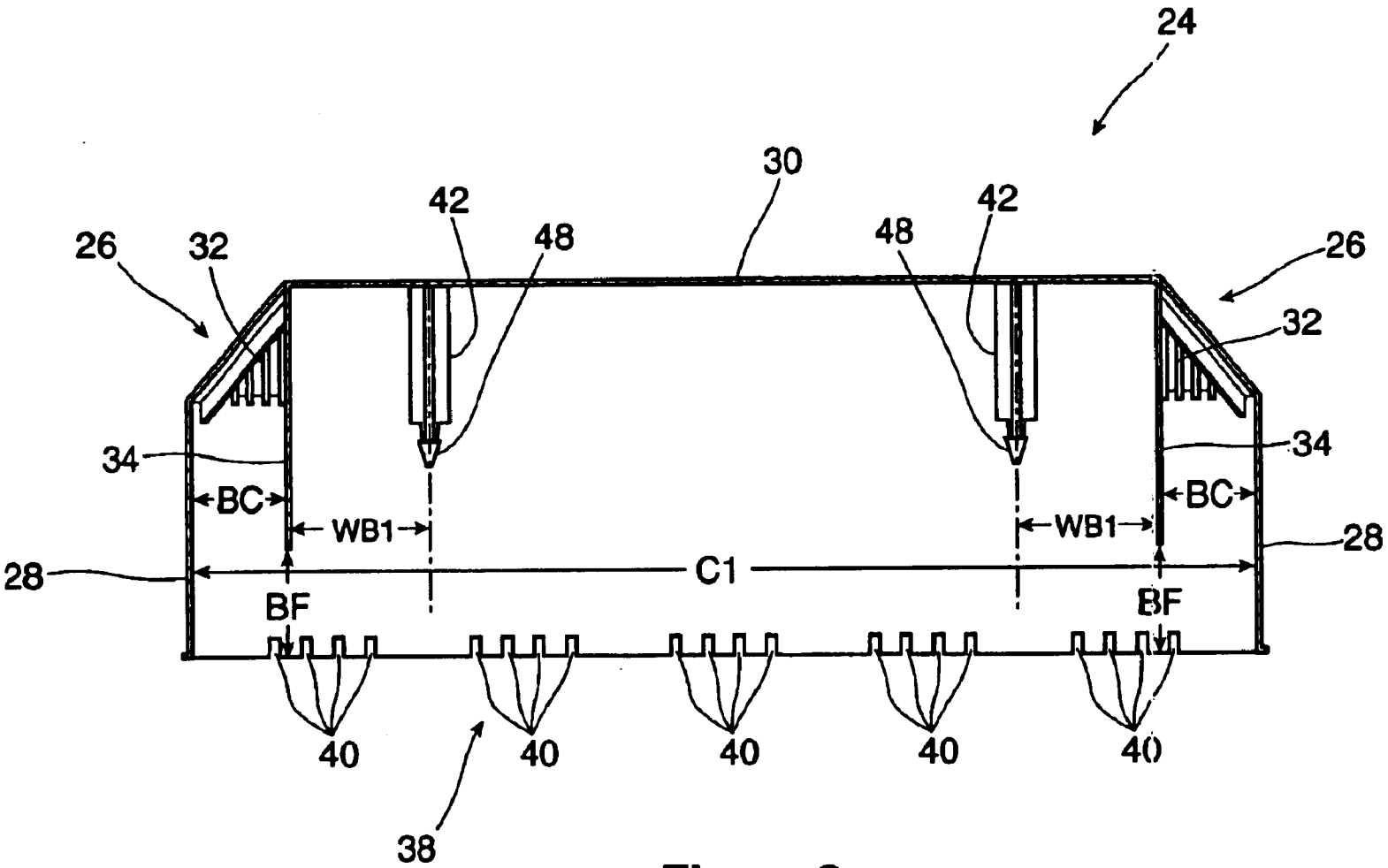
FIG. 9 is a cross-sectional view of the cover member taken along line 9—9 of FIG. 7, with the wall sections shown in dotted outline.
Figure 10:
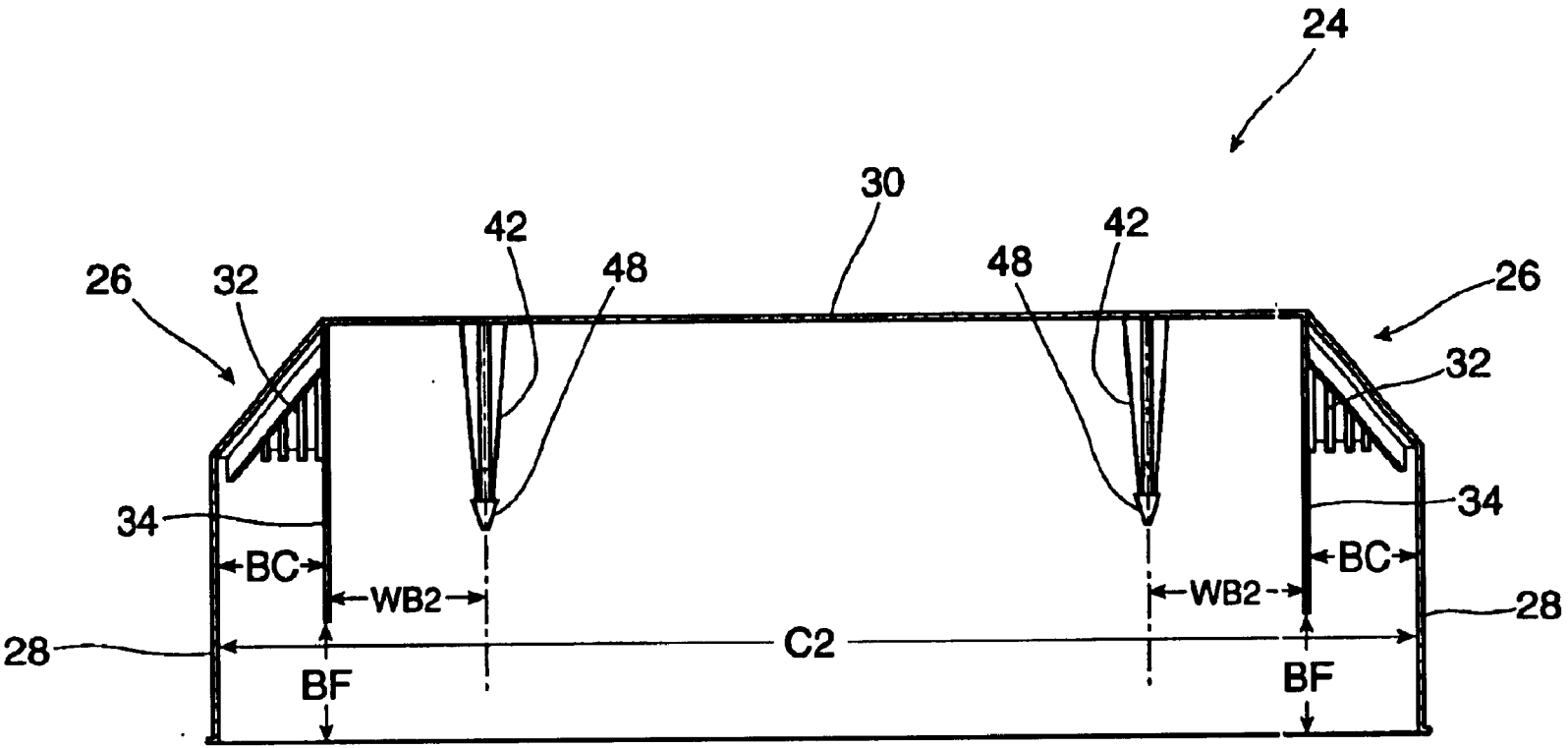
FIG. 10 is a cross-sectional view of the cover member taken along line 10—10 of FIG. 7, with the wall sections shown in dotted outline.
Figure 11:
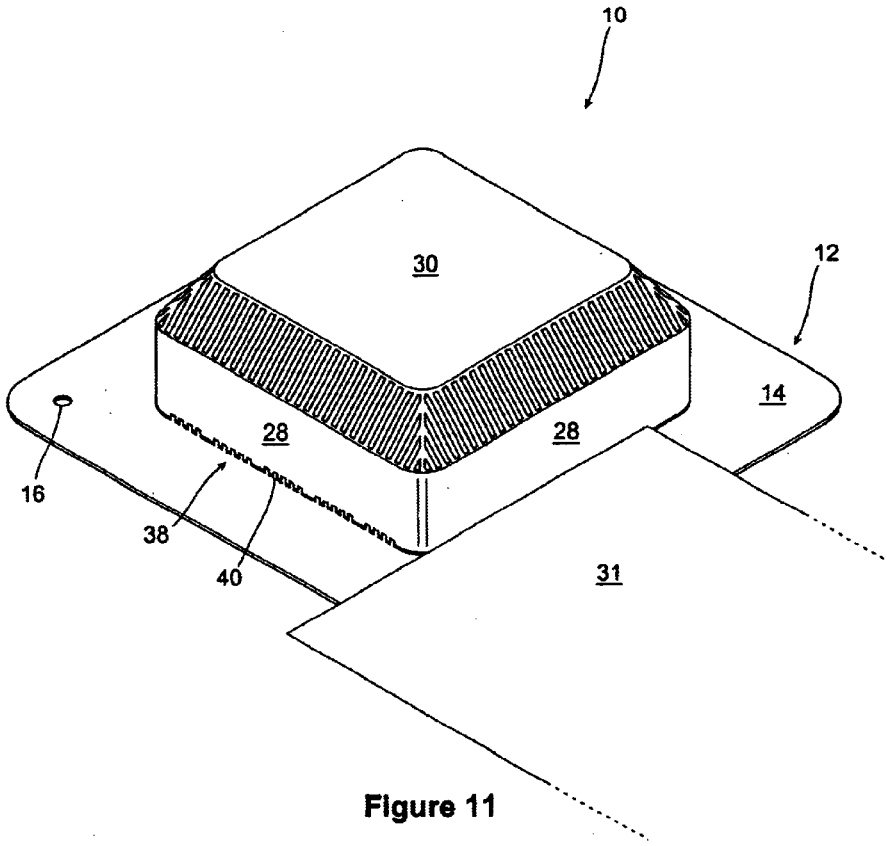
FIG. 11 is a perspective view of the passive venting device according to the present invention abutting roofing materials.

Most preferably, the cover member 24 is rectangular in plan view. On each side of the cover member 24, the lower portion 28 of the cover member 24 abuts the flange 14 and extends from the flange 14 in a generally vertical or generally upstanding direction. The ventilation pathway 26 then extends diagonally between the lower portion 28 and a flat top portion 30 of the cover member 24. In the preferred embodiment, the ventilation pathway 26 runs around the entire cover member 24 in a rectangular shape (as shown in FIG. 7) at the top end of the lower portion 28.

It will be appreciated that, when the preferred embodiment is used, gases and vapours leaving the pathway 26 will be travelling in an upward direction away from the roof. This is because the exit from the pathway 26 is spaced apart from the roof, and also the pathway 26 is oriented diagonally upward away from the roof. This has the advantage that warm, moist air being vented is not directed toward the shingles on the roof. In prior art devices such as the McKee device, the warm, moist air being vented flows out under the cap and contacts adjacent shingles. This often results in fungus growing on the shingles, which discolours them. In the preferred embodiment of the present invention, because the warm, moist air is vented in a direction away from the shingles, the discolouring fungus is less likely to grow on the shingles.

Preferably, the lower portion 28 is impervious to water and is sufficiently high so as to space the pathway 26 from the flange 14 so as to permit roofing materials 31 be installed abutting the cover member 24 without interference with the exit from the pathway 26. Most preferably, the exit from the pathway 26 will be spaced apart from the flange 14 sufficiently so that even cedar shakes or clay tiles can be installed abutting the cover member 24 without interference with the exit from the pathway 26.

Also, preferably, the ventilation pathway 26 is covered by a screen composed of individual screen members 32 extending across the ventilation pathway 26. The purpose of the screen members 32 is to prevent bugs, pests, rodents or debris from entering into the space under the cover member 24, and into the enclosure through the vent opening 20. Thus, the screen members 32 will preferably be spaced closely enough together to prevent such things from entering, while still allowing adequate air flow through the ventilation pathway 26.

It will be appreciated that the ventilation pathway 26 may have different configurations. For example, the pathway 26 could be comprised of one or more perforations through the cover member 24 which, together, are sized, shaped and positioned to permit the flow of gas and vapour from the vent opening 20 to the outside.

It will also be appreciated that the device 10 need not have a ventilation pathway 26 through the cover member 24 to fall within the scope of the invention. Instead, for example, the cover member 24 and the base member 12 could simply be spaced apart from one another, thus permitting gases and vapours to flow through the vent opening 20 to the outside between the cover member 24 and the base member 12. Other configurations are also possible. What is important is that the cover member 24 and the base member 12 be sized, shaped and positioned so as to permit the flow of gas and vapour from the vent opening 20 to the outside.

The device 10 further includes a precipitation baffle 34 extending from the cover member 24. The baffle 34 is preferably sized, shaped and positioned to interfere with the entry of precipitation from the outside into the enclosure through the vent opening 20, and to permit gas and vapour to flow through the vent opening 20 to the outside. The precipitation baffle 34 preferably extends downwardly from the cover member 24 adjacent to the ventilation pathway 26, along the entire ventilation pathway 26. Preferably, the baffle 34 extends far enough downward from the cover member 24 so that the lower edge of the baffle 34 is lower than the upper edges of the wall sections 19, 21 and 22.

As will be discussed in further detail below, the baffle 34 is, in the preferred embodiment, sized, shaped and positioned to cause precipitation entering the device through the ventilation pathway 26 to move to a precipitation control area 36. Specifically, precipitation entering the device will strike the baffle 34 and fall to the portion of the flange 14 between the wall sections 19, 21 and 22 and the cover member 24. In the preferred embodiment, this portion of the flange is the precipitation control area 36.

The cover member 24 preferably includes a precipitation flow pathway 38 connecting the precipitation control area 36 with the outside so as to permit precipitation to flow from the precipitation control area 36 to the outside. In the preferred embodiment, the precipitation flow pathway 38 comprises a series of apertures 40 in the lower portion 28 of the downward side of the cover member 24 (i.e. the side of the cover member 24 that faces downward when the device is installed on a sloped roof). The apertures 40 are preferably contiguous with the bottom edge of the cover member 24, such that, when the cover member 24 is mounted to the base member 12, the flange 14 acts as the bottom border of the apertures 40. Thus, precipitation such as rain and melted snow, which is in the precipitation control area 36, will tend to flow downward along the slope of the roof and out through the apertures 40 which are located at the downward side of the cover member 24.

The use of the small apertures 40 as the precipitation flow pathway 38 has the advantage of allowing precipitation to flow while preventing debris and pests from entering the space under the cover member 24.

It will be appreciated by those skilled in the art that, in cold weather, passive venting devices will typically absorb and conduct heat being created within the enclosure (e.g. by a furnace) faster than the surrounding roofing material. This is, in part, because warm air from the attic flows through the device 10 and warms it. Thus, typically, snow gathering on or near a device 10 will melt faster than snow on other parts of the roof. For this reason, snow in the precipitation control area 36 will typically melt relatively quickly, thus allowing it to flow through the flow pathway 38 to the outside. This melting will typically occur even if the outside temperature is below the snow's melting point.

Most preferably, apertures 40 will be located both on the downward side and the upward side of the lower portion 28. This construction has three benefits. First, this allows the upward and downward sides of the cover member 24, which include the apertures 40, to be interchangeable, so that either side can function as both the upward side and the downward side of the cover member 24. This makes it less likely that the device installer will install the cover member 24 incorrectly. After all, if the apertures 40 were only present on one side of the cover member 24, the installer could mistakenly mount the cover member 24 to the base member 12 so that the apertures 40 are facing up the sloped roof. This would eliminate the efficacy of the apertures 40 as a precipitation flow pathway 38, since precipitation will not flow upward. By contrast, with apertures 40 on both sides, the installer can mount the cover member 24 in two different ways, while still preserving the efficacy of the apertures 40 as a precipitation flow pathway 38. (Furthermore, as will be described below, the device is also preferably constructed so as to prevent the cover member 24 from being mounted such that the apertures 40 face sideways.)

Second, though the primary route for the venting of gases and vapours to the outside is through the ventilation flow pathway 26, the apertures 40 can act as a supplementary flow path. According to a preferred form of the present invention, each of the apertures 40 is sufficiently small to prevent pests from entering under the cover member 24. However, the total area of the apertures can provide a significant amount of supplementary area through which gases and vapours can flow, thus increasing the venting capability of the device. Thus, providing two sets of apertures 40 on opposite sides of the cover member 24 doubles the possible supplementary flow path.

Third, if apertures 40 were absent from the upward side of the cover member 24, water flowing downward from the upward side of the roof would strike the cover member 24 and be forced to flow sideways to get around the cover member 24. This could cause water to enter under the adjacent shingles from the side. Shingles on sloped roofs are overlapped so as to prevent water from leaking through the roof as it flows down the slope. However, this does not prevent water from entering under the shingles from the side. By placing apertures on the upward side of the cover member 24, water flowing down the roof can enter under the cover member 24 and flow out through the apertures 40 at the downward side of the vent This makes it less likely that water will deflect sideways and leak under the shingles.

It will be appreciated that the precipitation flow pathway 38 need not have the most preferred configuration as described above in order to fall with in the scope of the invention. Rather, what is important is that the base member 12 and the cover member 24 be sized, shaped and positioned so as to define a precipitation flow pathway 38 connecting the precipitation control area 36 and the outside, such that the precipitation flow pathway 38 is sized, shaped and positioned to permit precipitation to flow from the precipitation control area 36 to the outside.

The cover member 24 may be mounted to the base member 12 in any secure fashion. Conventional stake mounting has been found to be adequate. In the preferred embodiment, the cover member 24 is mounted by means of four mounting shafts 42 extending from the cover member 24, and four corresponding mounting slots 44 in the base member 12. The shafts 42 are positioned on the cover member 24 so as to line up with the slots 44 in the base member 12. The mounting slots 44 are positioned on the base member 12, each adjacent to a corner of the vent opening 20. The mounting slots 44 are formed integrally with the lateral wall sections 19. Each mounting slot 44 has lips 46 at its opening. The lips 46 are compressible inwardly (i.e. into the slots 44), but not outwardly, and are biased to return to a closed position when not compressed.

Each mounting shaft 42 has a head 48 at its tip, the head 48 being wider than the shaft 42 at the point of attachment between the head 48 and the shaft 42. To mount the cover member 24 on the base member 12, the shafts 42 are lined up with the slots 44. The shafts 42 are then inserted into the slots 44. The lips 46 compress inward as the shafts 42 are inserted. Once the heads 48 move past the lips 46, the lips 46 move back to the closed position. As the lips 46 are not movable outward, the lips 46 hold the heads 48 in the slots 44, thus mounting the cover member 24 onto the base member 12.

Preferably, the slots 44 and the corresponding shafts 42 are distributed in a pattern that is rectangular, but not square, in plan view. In this way, there are only two possible positions (displaced by 180 degrees from one another) that the cover member 24 can have relative to the base member 12. The apertures 40 are positioned such that, in both those positions, the apertures 40 are located on the upward side and the downward side of the cover member 24. Moreover, because of the distribution of the slots 44 and shafts 42, it is not possible to mount the cover member 24 so that the apertures 40 are not positioned at the downward side of the cover member 24. This is because, if an attempt is made to mount the cover member 24 in such a position, the slots 44 and shafts 42 will not line up. This prevents the installer of the device from accidentally mounting the cover member 24 so that apertures 40 are not positioned at the downward side of the cover member 24.

The cover member 24 is also preferably rectangular, but not square, in plan view. The base member 12 further preferably includes guide members 50 protruding from the flange 14. The guide members 50 are distributed on the flange 14 just inside where the cover member 24 abuts the flange 14 when the cover member 24 is mounted, so that when the cover member 24 is mounted, the guide members 50 are covered. The guide members 50 are also positioned so that they do not interfere with or block the apertures 40.

Because the cover member 24 is rectangular but not square, the guide members 50 are distributed accordingly. Thus, there are only two positions (displaced 180 degrees from one another) at which the guide members 50 will allow the cover member 24 to be mounted. The apertures 40 are positioned on the cover member 24 so that, in either position, apertures 40 will be positioned at the downward end of the cover member 24. If the installer attempts to position the cover member 24 such that the apertures 40 are facing sideways, the guide members 50 will interfere. Thus, the guide members 50, combined with the rectangular and non-square shape of the cover member 24, function as another check on incorrect mounting of the cover member 24.

Of course, in order to ensure that there are apertures 40 facing toward the downward side of the sloped roof, so that precipitation will flow from the precipitation control area 36 through the apertures 40 to the outside, the base member 12 must also be installed correctly. If the base member 12 is installed in an incorrect orientation on the sloped roof, then even if the cover member 24 is mounted to the base member 12 correctly, the apertures 40 may still not be positioned so as to be facing downward on the sloped roof. Therefore, preferably, the base member 12 is provided with an orientation indicator 51 for indicating the correct orientation of the base member 12. The indicator 51 is preferably positioned on the flange 14, and indicates which side of the base member 12 should be facing upward along a sloped roof such that, when the cover member 24 is mounted correctly, apertures 40 are facing the upward side and the downward side of the sloped roof.

As discussed above, a common problem with venting device is snow being forced by wind through the ventilation passage and into the attic. This results from the fact that prior art devices are typically constructed so that air flows from the ventilation passage under the cap to the outside. Therefore, when snow gathers near the bottom of the cap, it is susceptible to being blown up under the cap and through the ventilation passage into the attic.

In the present invention, however, the baffle 34 is sized, shaped and positioned to interfere with the entry of precipitation into the enclosure through the vent opening 20. In the preferred embodiment, snow blowing in through the ventilation pathway 26 will strike the baffle 34 and move downward to the precipitation control area 36, because the baffle 34 extends across the straight-line path between the ventilation pathway 26 and the vent opening 20.

Furthermore, in the preferred embodiment, the exit from the ventilation pathway 26 is spaced from the flange 14 and the roof by the lower portion 28. Thus, snow accumulating on the roof is unlikely to be blown into the ventilation pathway 26. Rather, if picked up by wind, it would typically strike the lower portion 28 and simply be deflected away without entering under the cover member 24. Thus, unlike the prior art devices in which snow, for example, having moved through the lower gap must only go up and over into the vent structure, the flow in the present invention is up to get through the cover, down to get under the baffle and then up and over to get through the vent structure. Each curve acts as a flow separator to cause airborne particles (snow, rain) to drop out. This more sinuous flow path improves the weather resistance of the vent.

In addition, as described above, the other primary cause of precipitation entering attics through venting devices is torrential rain. While prior art devices, such as McKee, are generally effective at blocking ordinary rainfall, they are often less effective in keeping torrential rain from entering the attic. There are a number of reasons for this. First, torrential rains are of such high volume and fall with such force, that a significant amount of water bounces up under the cap of the McKee device and into the attic. Second, torrential rains are more often accompanied by strong and/or swirling winds, which can blow water up under the cap and into the attic.

In the present invention, most rain falling through the pathway 26 would strike the baffle 34, and as a result move to the precipitation control area 36. Nevertheless, because the baffle 34 does not extend all the way to the flange 14 (so as to allow gases and vapours to flow out through the vent opening 20 and the ventilation pathway 26), it is theoretically possible for torrential rain entering through the ventilation pathway 26, to strike the flange 14 and bounce up under and behind the baffle 34. Moreover, on a sloped roof, much more precipitation will enter through the portion of ventilation pathway 26 facing the upward side of the roof, because, by virtue of the slope of the roof, that portion of the ventilation pathway 26 will be oriented most closely to the horizontal, and, thus, rain approaching from a wider variety of angles will be able to enter. By contrast, because of the slope of the roof, the portion of the ventilation pathway 26 at the downward side of the device will be oriented most closely toward the vertical, and, thus, only rain approaching from a relatively narrow range of angles would enter the device at this point.

Thus, the device preferably includes a wall extension 52 extending upward toward the cover member 24 from the upward wall section 21. The wall extension 52 will preferably be integral with the upward wall section 21. By its positioning, the wall extension 52 fills in part of the gap between the upward wall section 21 and the cover member 24.

The purpose of the wall extension 52 is to block water that has bounced up under the baffle 34 from entering the attic through the vent opening 20. Because far more rain will enter through the upward side, the wall extension 52 is preferably positioned on the upward wall section 21, where it is most useful. Thus, the wall extension 52 acts as an additional barrier to the entry of precipitation through the vent opening 20 from the upper end of the device. The wall extension 52 preferably spans substantially the entire width of the upward wall section 21.

It will be appreciated that the wall extension 52 need not have the exact configuration described. What is important is that the wall extension 52 be carried by the vent structure wall and be sized, shaped and positioned to act as a barrier to the entry of precipitation from the upper end of the device through the vent opening 20.

It will be appreciated that the wall extension 52, because it extends upward toward the cover member 24, reduces the area available for the flow of gases and vapours to the outside by reducing the flow area available between the cover member 24 and the upper wall section 21. Thus, to compensate for this lost air flow area, the downward wall section 22 is preferably shaped so as to define a cut-out area 54 at its top end. Thus, because of the cut-out area 54, the downward wall section 22 does not extend as far upward from the flange 14 as, say, the lateral wall sections 19. As the purpose of the cut-out area 54 is to compensate for the lost air flow area resulting from the presence of the extension 52, the cut-out area 54 and the wall extension 52 will most preferably have the same area, and most preferably, the same dimensions. The result is that there is no net loss of air flow area as compared with a device having no wall extension 52 and no cut-out area 54.

It will also be appreciated that, because of the cut-out area 54 in the downward wall section 22, the downward wall section 22 provides less of a barrier to the entry of precipitation into the enclosure through the vent opening 20. However, since far less precipitation enters the ventilation pathway 26 at the downward side, the presence of the cut-out area 54 will not necessarily result in the greater entry of precipitation into the enclosure. Moreover, because the entry of precipitation through the ventilation pathway 26 is much greater at the upward end, the extra barrier provided by the extension 52 is preferred at the upward end.

Testing of two versions of the device 10 has been conducted, one with no extension 52 and no cut-out area 54, and one with an extension 52 and a cut-out area 54. The testing simulated the situation of the device 10 installed on a sloped roof under conditions of torrential rain. The testing found that the device 10 having no extension 52 and no cut-out area 54 allowed a minuscule, but measurable amount of water to enter the simulated attic. By contrast, the device 10 having a wall extension 52 and a cut-out area 54 admitted no measurable amount of water into the simulated attic.

The testing showed that, even without the extension 52 and cut-out area 54, the preferred embodiment of the present invention was more effective in excluding water from an attic during torrential rains than prior art devices such as the McKee device. There are at least two likely reasons for this. First, the baffle 34 will block most of the rain entering through the ventilation pathway 26, even if driven by wind, because the baffle 34 blocks the straight-line path between the pathway 26 and the vent opening 20. Second, the screen members 32 will block some of the rain from entering through the ventilation pathway 26. Even raindrops that enter through the pathway 26 are likely to strike a screen member 32 before entering, thus scattering the raindrop and slowing it down significantly. This makes it less likely that the water will have sufficient energy to bounce up under the baffle 34 and up into the vent opening 20.

To the extent that some very small amount of water can reach the vent opening 20 when no extension 52 is present, the testing also shows that the extension 52 further reduces the amount of water admitted to a simulated attic under simulated torrential rain conditions to an unmeasurably small amount. Furthermore, even with the cut-out area 54 present, no measurable amount of water is admitted. Therefore, the device 10 most preferably (but not necessarily) will have an extension 52 and cut-out area 54 as described above.

It will be appreciated that the baffle 34 need not be capable of completely preventing all precipitation from entering the vent opening 20 in order to be within the scope of the invention, though it is preferable if the baffle 34 does substantially completely prevent the entry of precipitation. Rather, the baffle 34 need only be sized, shaped and positioned to interfere with the entry of precipitation in the vent opening 20. So, for example, any configuration in which the baffle 34 is interposed between the ventilation pathway 26 and the vent opening 20 could accomplish this result, because the path of the precipitation into the vent opening 20 is interfered with, thus reducing the amount of precipitation that would eventually make it into the vent opening 20 from the outside. This would include, for example, a configuration in which there is a gap between the cover member 24 and the flange 14, and the air flows outside by flowing between the cover member 24 and the flange 14, as long as the baffle 34 is interposed between the vent opening 20 and the gap. Any other configuration for the baffle 34 which interferes with (i.e. reduces the amount on precipitation entering the vent opening 20 from the outside may be within the scope of the invention.

Passive venting devices such as the one described herein are usually used as part of a venting system for venting enclosures such as attic spaces. The bigger the enclosure, the more venting is typically required. Venting capacity can be varied either by providing more vents, or by using individual venting devices which have either higher or lower venting capacities.

Passive venting devices are typically specified and located according to a functional characteristic called nominal net airflow area. The net airflow area is a measurement of the venting capacity of the venting device. The greater the net airflow area, the greater the venting capacity of the venting device.

Net airflow area is typically determined with reference to the cross-sectional area of the airflow path. So, for example, the Canadian Standards Association (which sets standards for a wide variety of products) states in its CSA Standard CAN3-A93-M82 that "[i]t is assumed that the smallest cross-sectional area of the airflow pathway will normally be the controlling factor with respect to the passage of air."

In the present invention, the airflow area of the ventilation pathway 26 (which is partially covered by the screen members 32), together with the airflow area of the apertures 40, determines the net airflow area of the device 10. For the device 10 to have a particular nominal airflow area, the net airflow area of the pathway 26 (i.e. the space between the screen members 32) together with the apertures 40 must equal or exceed the nominal airflow area. It will be appreciated that the airflow area of the pathway 26 can be varied in a number of ways, including varying the width of the members 32, varying the spacing of the members 32, varying the width of the pathway 26, or varying the length of the pathway 26 (by extending the length or width of the cover member 24). Thus, the ventilation pathway 26, the members 32 and the apertures 40 are sized, shaped and positioned to provide a total airflow area of at least the nominal airflow area.

It will be appreciated that the need to achieve the predetermined nominal airflow area for the device 10 as determined by the airflow area of the pathway 26 and/or the apertures 40 will also affect the size, shape and positioning of the cover member 24, the baffle 34, the vent opening 20, and the wall sections 19, 21 and 22. Thus, for example, the vent opening 20 is sized and shaped so that it will have an airflow area of at least the predetermined nominal airflow area. Also, the distance between the wall sections 19, 21 and 22 and the cover member 24 (shown as distance WC in the drawings) is sized and shaped so that the total airflow area for air flowing out of the enclosure through the vent opening 20 and over the wall sections 19, 21 and 22 is at least the nominal airflow area.

Similarly, the distances between the wall sections 19, 21 and 22 and the baffle 34 (shown as WB1 and WB2 in the drawings) are sized and shaped so that the total airflow area of the space between the wall section 19, 21 and 22 and the baffle 34 is at least the nominal airflow area. The distance between the baffle 34 and the flange 14 (shown as distance BF in the drawings) is sized and shaped so that the total airflow area of the space between the baffle 34 and the flange 14 is at least the net airflow area. The distance between the baffle 34 and the cover member 24 (shown as distance BC in the drawings) is also sized and shaped such that the total airflow area of the space between the baffle 34 and the cover member 24 is at least the nominal airflow area.

It will be appreciated that these specifically identified distances are applicable to the preferred embodiment. In other embodiments with slightly different configurations, these specifically identified distances may not be applicable. However, what is important with respect to achieving a predetermined nominal airflow area for any embodiment of the invention is that the components of the device 10 affecting airflow area, such as the cover member 24, the pathway 26, the baffle 34, the base member 12, and/or the vent structure 18 be sized, shaped and mutually positioned so as to preserve an airflow area for air flowing from the enclosure to the outside through the vent opening 20 that is, at its minimum, at least the predetermined nominal airflow area.

For example, it may be desired to extend the baffle 34 downward as far as possible to ensure that it intercepts precipitation as effectively as possible. However, if the baffle 34 extends too far downward from the cover member 24 (i.e. if the distance BF is too short), then the net airflow area will be reduced below the predetermined nominal net airflow area.

A common desired nominal airflow area, particularly in the North American roof vent market, is 50 square inches. In the embodiment of the invention having this predetermined nominal airflow area, the pathway 26, members 32 and apertures 40 will be sized, shaped and positioned to provide an actual airflow area of at least 50 square inches. It will be appreciated that, according to some standards such as the CSA standard mentioned above, the device 10 is accepted as having a certain nominal airflow area if its actual airflow area is within a specified tolerance, such as, for example, plus or minus 0.75 inches from nominal.

An embodiment of the invention will now be described wherein the predetermined nominal airflow area is 50 inches, and in which the components of the device 10 are sized, shaped and positioned to preserve an airflow area of at least the predetermined nominal airflow area.

The vent opening 20 is substantially rectangular. The distance between the upward wall section 21 and the downward wall section 22 (shown as distance UD in the drawings) is approximately 7.25 inches. The distance between the lateral wall sections 19 (shown as distance LL in the drawings) is approximately 7.15 inches. Thus, vent opening 20 is sized and shaped to have an area of approximately 51.8 square inches, which is greater than the predetermined nominal airflow area of 50 square inches.

The distance WC (which relates to the distance between the wall sections and the top portion 30 of the cover member 24 at a point away from the cut-out 54 and the extension 52) is approximately 1.825 inches. The height of the lateral wall sections 19 is approximately 2.67 inches from the flange 14. The airflow area from the vent opening 20 over the wall sections 19, 21 and 22 is calculated approximately by the formula 1.825*(2*UD+2*LL), which equals approximately 52.6 square inches. Thus, the wall sections 19, 21 and 22 and the cover member 24 are sized, shaped and mutually positioned to preserve an airflow area between the cover member 24 and the wall sections 19, 21 and 22 of at least the predetermined nominal airflow area of 50 square inches. Note that, because the extension 52 and the cut-out 54 have the same area and cancel each other out, the airflow area can be calculated by assuming that both are absent.

The distances WB1 and WB2 are approximately 1.695 inches and 1.395 inches respectively. The baffle 34 follows a rectangular path in plan view with dimensions of approximately 10.54 inches (B1) by 10.04 inches (B2). The airflow area between the baffle 34 and the wall sections 19, 21 and 22 is approximately calculated by the formula {B1*B2–UD*LL}. The airflow area between the baffle 34 and the wall sections 19, 21 and 22 is approximately 54 square inches, which is greater than 50 square inches. Thus, the wall sections 19, 21 and 22, as well as the baffle 34, are sized, shaped and mutually positioned so that the airflow area of the space between the baffle 34 and the wall sections 19, 21 and 22 is equal to or greater than the predetermined nominal airflow area of 50 square inches.

The distance BF is approximately 1.275 inches. The airflow area of the space between the baffle 34 and the flange 14 is calculated approximately by the formula 2*BF*{B1+B2}, which equals approximately 52.5 square inches, which is greater than 50 square inches. Thus, the baffle 34 is sized, shaped and positioned so that the airflow area of the space between the baffle 34 and the flange 14 is equal to or greater than the predetermined nominal airflow area of 50 square inches.

The distance BC is approximately 1.202 inches. The cover member 24 is rectangular having inner dimensions of approximately 12.944 inches (C1) by 12.444 inches (C2). The airflow area for the space between the baffle 34 and the cover member 24 can be approximately calculated by the formula {C1*C2–B1*B2}, which in this embodiment equals approximately 55 square inches, which is greater than or equal to 50 square inches. Thus, the baffle 34 and the cover member 24 are sized, shaped and mutually positioned so that the airflow area of the space between the baffle 34 and the cover member 24 is equal to or greater than the predetermined nominal airflow area of 50 square inches.

Thus, it will be appreciated that the components of the device 10 which affect the actual airflow area, which include in the preferred embodiment the cover member 24, the vent opening 20, the wall sections 19, 21 and 22 and the baffle 34, are sized, shaped and positioned so that the actual airflow area is at least the predetermined nominal airflow area. It will further be appreciated that it is preferable that the actual airflow area exceed the predetermined nominal airflow area by as little as is practicable. This allows the predetermined nominal airflow area to be achieved with as small a device 10 as possible, while still allowing the user of the device 10 to rely on the device 10 having its stated nominal airflow area.

It will be further appreciated that the present invention comprehends that there be a relationship between the position of the baffle 34 as defined by BC and by BF. To block precipitation most effectively, BF should be as small as possible. Thus, BC should also be as small as possible to permit BF to be small, because the smaller BC is, the smaller BF can be while still providing sufficient airflow area through the space between the baffle 34 and the flange 14. By contrast, the larger BC is, the larger BF needs to be to provide the same airflow area.

Similarly, it will be further appreciated that the present invention comprehends that there be a relationship between WC on the one hand and UD and LL on the other. To block precipitation, WC should be as small as possible. The larger UD and/or LL are, the smaller WC can be while still maintaining the same airflow area over the wall sections 19, 21 and 22. By contrast, the smaller UD and/or LL are, the greater WC needs to be to have the same airflow area over the wall sections 19, 21 and 22.

As stated above, the actual airflow area of the device 10 is determined by the smallest cross-sectional area of the ventilation pathway i.e. the smallest choke point for airflow. This smallest choke point could be at BC, at BF, at WB, at WC or at the vent opening 20, depending on the size, shape and position if the wall sections 19, 21, and 22, the baffle 34, the cover member 24 and the vent opening 20. These components are sized, shaped and positioned to increase the effectiveness of the device 10 in excluding precipitation, as described above. It will also be appreciated that, most preferably, all of these choke points would have an area exactly equal (or substantially exactly equal) to the nominal airflow area. That way, the device 10 would be as compact as possible, while still achieving the nominal airflow area. In turn, the compactness results in the device 10 requiring less raw material for manufacture, which in turn would make it less expensive to manufacture.

Nevertheless, it has been found that good results are obtained if the wall sections 19, 21, and 22, the baffle 34, the cover member 24 and the vent opening 20 are sized, shaped and positioned so that none of the choke points provides an airflow area of more than 10 percent more the nominal airflow area. For example, this would mean that, for a 50 square inch nominal airflow area, the actual airflow area at each of BC, BF, WB, WC or the vent opening 20 would be less than or equal to 55 square inches. It has also been found that acceptable results are obtained if none of the choke points provides an airflow area of more than 25 percent above the nominal airflow area.

Various modifications and alterations are possible to the form of the invention without departing from the scope of the broad claims as attached hereto. For example, the predetermined nominal airflow area need not be 50 square inches, but may be any amount desired. Also, the cover member 24 need not be rectangular in plan view as described with respect to the preferred embodiment. What is important is to provide is a passive venting device 10 that can be manufactured and installed simply and inexpensively. The device 10 will allow for the efficient passive venting of an enclosure while preferably eliminating or substantially reducing the entry of precipitation into the enclosure through the device 10. The device 10 will also preferably be usable with a variety of roofing materials, including shakes and tiles, without air flow through the vent being interfered with.

I claim:

1. A passive venting device for venting a building enclosure to an outside, the device comprising:

a base member, including an attachment portion for securing the base member in fluid communication with a ventilation passage through a surface of the building enclosure, and a vent structure attached to said attachment portion for permitting gas and vapour to pass through the device, the vent structure having a vent opening;

a cover member mounted to the base member, the cover member and the base member being sized, shaped and positioned so as to define a flow path for the flow of gas and vapour from the vent opening to the outside;

a precipitation baffle, extending from at least one of the base member and the cover member, the precipitation baffle being sized, shaped and positioned both to interfere with the entry of precipitation from the outside into the enclosure through the vent opening, and to permit gas and vapour to flow to the outside through the vent opening;

the cover member and base member being sized, shaped and positioned so as to block snow from entering under the cover member by blowing between the cover member and the base member.

2. The device of claim 1, the precipitation baffle extending from the cover member.

3. The device of claim 2, the precipitation baffle being sized, shaped and positioned to cause precipitation entering the device from the outside to move to a precipitation control area.

4. The device of claim 3, the cover member and the base member being sized, shaped and positioned to define a precipitation flow pathway connecting the precipitation control area and the outside, the pathway being sized, shaped and positioned to permit precipitation to flow from the precipitation control area to the outside.

5. The device of claim 4, the precipitation flow pathway comprising a pathway through the cover member.

6. The device of claim 3, the precipitation control area being located under the cover member and on the base member.

7. The device of claim 2, the flow path including a ventilation pathway extending through the cover member, the ventilation pathway being sized, shaped and positioned to permit the flow of gas and vapour from the vent opening to the outside along the ventilation pathway.

8. The device of claim 7, the cover member being sized, shaped, and positioned on the base member, such that roofing material may be installed in abutment with the cover member, the ventilation pathway having an exit from the cover member, the exit being spaced from the base member so as to permit the roofing material to be installed in abutment with the cover member without the roofing material interfering with the exit.

9. The device of claim 8, wherein the cover member abuts the attachment portion and extends therefrom in a generally upstanding direction.

10. The device of claim 8, the precipitation baffle being sized, shaped and positioned to direct, to a precipitation control area, precipitation entering the device from the outside.

11. The device of claim 10, the base member and the cover member being sized, shaped and positioned so as to define a precipitation flow pathway connecting the precipitation control area and the outside, the precipitation flow pathway being sized, shaped and positioned to permit the precipitation to flow from the precipitation control area to the outside.

12. The device of claim 11, the precipitation control area being located on the base member under the cover member.

13. The device of claim 12, the precipitation flow pathway comprising a pathway through the cover member.

14. The device of claim 2 or claim 8, wherein the device has a predetermined nominal net airflow area, the precipitation baffle being sized, shaped and positioned so as to preserve a net airflow area of at least the nominal net airflow area.

15. The device of claim 1, the vent structure including a vent structure wall, the device further including a wall extension carried on the vent structure wall, the wall extension being sized, shaped and positioned to act as a barrier to the entry of precipitation from an upper end of the device through the vent opening.

16. The device of claim 15, the vent structure wall including an upward wall section, the wall extension extending from the upward wall section toward the cover member.

17. The device of claim 16, the wall extension extending toward a top portion of the cover member.

18. The device of claim 1, wherein the flow path comprises an uncloseable flow path.

19. A passive venting device for venting a building enclosure to an outside, the device comprising:

a base member, including an attachment portion for securing the base member in fluid communication with a ventilation passage through a surface of the building enclosure, and a vent structure for permitting gas and vapour to pass through the device, the vent structure having a vent opening;

a cover member mounted to the base member, the cover member and the base member being sized, shaped and positioned so as to define an uncloseable flow path for the flow of gas and vapour from the vent opening to the outside, the flow path including a ventilation pathway extending through the cover member, the flow path having an airflow area;

the cover member being sized, shaped and positioned on the base member such that roofing material may be installed in abutment with the cover member, the flow path being positioned such that the roofing material may be installed abutting the cover member without reducing the airflow area.

20. The device of claim 19, wherein the cover member abuts the attachment portion and extends therefrom in a generally upstanding direction.

21. The device of claim 19, the device further including a precipitation baffle, extending from at least one of the base member and the cover member, the precipitation baffle being sized, shaped and positioned both to interfere with the entry of precipitation from the outside into the enclosure through the vent opening, and to permit gas and vapour to flow to the outside through the vent opening.

22. The device of claim 21 the precipitation baffle extending from the cover member.

23. The device of claim 22, the precipitation baffle being sized, shaped and positioned to cause precipitation entering the device from the outside to move to a precipitation control area.

24. The device of claim 23, the cover member and the base member being sized, shaped and positioned to define a precipitation flow pathway connecting the precipitation control area and the outside, the pathway being sized, shaped and positioned to permit precipitation to flow from the precipitation control area to the outside.

25. The device of claim 24, the precipitation flow pathway comprising a pathway through the cover member.

26. The device of claim 23, the precipitation control area being located on the base member under the cover member.

27. The device of claim 21, wherein the device has a predetermined nominal net airflow area, the precipitation baffle being sized, shaped and positioned so as to preserve a net airflow area of at least the nominal net airflow area.

28. The device of claim 19, said roofing materials including one of shakes or tiles.

29. The device of claim 19, the vent structure including a vent structure wall, the device further including a wall extension carried on the vent structure wall, the wall extension being sized, shaped and positioned to act as a barrier to the entry of precipitation from an upper end of the device through the vent opening.

30. The device of claim 29, the vent structure wall including an upward wall section, the wall extension extending from the upward wall section toward the cover member.

31. The device of claim 30, the wall extension extending toward a top portion of the cover member.

* * * * *